US006408861B1

(12) United States Patent
Ortega

(10) Patent No.: US 6,408,861 B1
(45) Date of Patent: Jun. 25, 2002

(54) URINE BAG CLEANING MANIFOLD

(76) Inventor: John Ortega, 486 W. 91st. Cir., Thornton, CO (US) 80221

( * ) Notice: Subject to any disclaimer, the term of this patent is extended or adjusted under 35 U.S.C. 154(b) by 0 days.

(21) Appl. No.: 09/422,809

(22) Filed: Oct. 21, 1999

(51) Int. Cl.[7] ..... B08B 9/00

(52) U.S. Cl. ..... 134/100.1; 134/169 R; 134/171

(58) Field of Search ..... 134/166 R, 169 R, 134/100.1, 170, 171; 604/332, 334, 277

(56) References Cited

U.S. PATENT DOCUMENTS 1,757,035 A * 5/1930 Beckman
3,040,755 A * 6/1962 Sigmon et al.
3,629,005 A * 12/1971 Belden
3,672,391 A * 6/1972 Livingston et al.
4,134,404 A * 1/1979 Williams, Jr.
4,285,076 A * 8/1981 Dickstein
4,354,514 A * 10/1982 Sundheimer et al.
4,445,522 A * 5/1984 Schmid
4,552,728 A * 11/1985 Taylor
4,654,037 A * 3/1987 Fenton
4,766,622 A * 8/1988 Pacelli
4,919,160 A * 4/1990 Pierce
4,941,878 A * 7/1990 Petrik
4,995,410 A * 2/1991 Lash
5,096,503 A * 3/1992 Wellman
5,225,160 A * 7/1993 Sanford et al.
5,454,389 A * 10/1995 Hubbard et al.
5,503,633 A * 4/1996 Saunders et al.
5,543,119 A * 8/1996 Sutter
5,554,228 A * 9/1996 Giordano et al.
5,642,744 A * 7/1997 O'Laughlin et al.
5,709,236 A * 1/1998 Rodriguez
5,738,668 A * 4/1998 Bugajski
5,921,256 A * 7/1999 Barin
6,001,086 A * 12/1999 Rammacher
6,039,060 A * 3/2000 Rower

* cited by examiner

*Primary Examiner*—Frankie L. Stinson
(74) *Attorney, Agent, or Firm*—Edwin H. Crabtree; Ramon L. Pizarro; Donald W. Margolis

(57) ABSTRACT

A urine bag cleaning manifold capable of pre-mixing a cleaning solution and water for washing one or more urine bags. The bags are then rinsed and allowed to dry. The urine bag cleaning manifold is adapted for attaching to a bathroom sink faucet, bathtub faucet and other faucets for circulating the warm water from the faucet and the cleaning solution therethrough. The cleaning manifold includes a flexible inlet tube having a first end and a second end. The first end of the inlet tube is adapted for connection to the faucet. The second end of the inlet tube is attached to an inlet of a water inlet valve. An outlet of the water inlet valve is attached to a first end of an upstream mixing section. The upstream mixing section is part of a hollow manifold body. The hollow manifold body also includes a downstream discharge section. A second end of the mixing section is attached to a first end of the discharge section. A cleaning solution container is mounted on top of a cleaning solution valve. The cleaning solution valve is attached to sides of an opening in an upper portion of the mixing section. A plurality of outlet valves are attached to sides of openings in a lower portion of the discharge section. A first end of a plurality of outlet tubes is attached to the outlet valves. A second end of the outlet tubes is adapted for attachment to the urine bags.

11 Claims, 2 Drawing Sheets

URINE BAG CLEANING MANIFOLD

BACKGROUND OF THE INVENTION (a) Field of the Invention

This invention relates in general to cleaning urine retention bags and more particularly, but not by way of limitation, to cleaning bodily discharge retention bags, night drainage containers and associated tubing.

(b) Discussion of Prior Art

Heretofore, there have been a variety of different types of bodily discharge baa cleaning systems. In U.S. Pat. No. 5,642,744 to O'Laugahlin et al., an attachment is disclosed that attaches between a standard household faucet and a urostomy collector. In U.S. Pat. No. 5,735,301 to Rower, a venturi system is disclosed wherein a cleaning solution is drawn upward into a high velocity water stream to flush a urostomy container.

In U.S. Pat. Nos. 5,709,236 to Rodriguez and U.S. Pat. No. 5,738,668 to Bugaiski, hand-held valves are illustrated that are used with a spray wand. The wand uses faucet water to hand spray the inside of a colostomy bag for cleaning. U.S. Pat. No. 2,223,566 to Koch discloses a colostomy irrigator which is adapted to use faucet water to clean a colostomy container.

None of the above mentioned patents disclose or teach the unique features and combination of structure making up the subject invention with the advantages and benefits to the user of the equipment as described herein.

SUMMARY OF THE INVENTION

In view of the foregoing, it is a primary object of the subject invention to provide an efficient and easy to use urine bag cleaning manifold. The cleaning manifold is capable of pre-mixing a cleaning solution and water for cleaning the inside of one or more urine bags. The bag can also be rinsed using water from the manifold.

Another object of the invention is the urine bag cleaning manifold is adapted for attaching to a bathroom faucet, bathtub faucet and other faucets for circulating warm water and the cleaning solution therethrough and allowing the cleaning of multiple urine bags using a standard household sink or bathtub.

Still another object of the urine bag cleaning manifold is different types of cleaning solutions can be used in varying proportions to the water flow-rate to accommodate different numbers of urine bags to be cleaned at the same time.

Yet another object of the cleaning manifold is through the use of a water inlet valve and a cleaning solution valve, the amount of water and the amount of cleaning solution can be controlled for mixing inside a hollow manifold body. Also the manifold includes outlet tubes with outlet valves for controlling the water and cleaning solution mixture to the inside of the urine bags.

The urine bag cleaning manifold includes a flexible inlet tube having a first end and a second end. The first end of the inlet tube is adapted for connection to the faucet. The second end of the inlet tube is attached to an inlet of a water inlet valve. An outlet of the water inlet valve is attached to a first end of an upstream mixing section. The upstream mixing section is part of a hollow manifold body. The hollow manifold body also includes a downstream discharge section. A second end of the mixing section is attached to a first end of the discharge section. A cleaning solution container is mounted on top of a cleaning solution valve. The cleaning solution valve is attached to sides of an opening in an upper portion of the mixing section. A plurality of outlet valves are attached to sides of openings in a lower portion of the discharge section. A first end of a plurality of outlet tubes is attached to the outlet valves. A second end of the outlet tubes is adapted for attachment to one or more of the urine bags.

These and other objects of the present invention will become apparent to those familiar with various types of urine bag cleaning systems when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
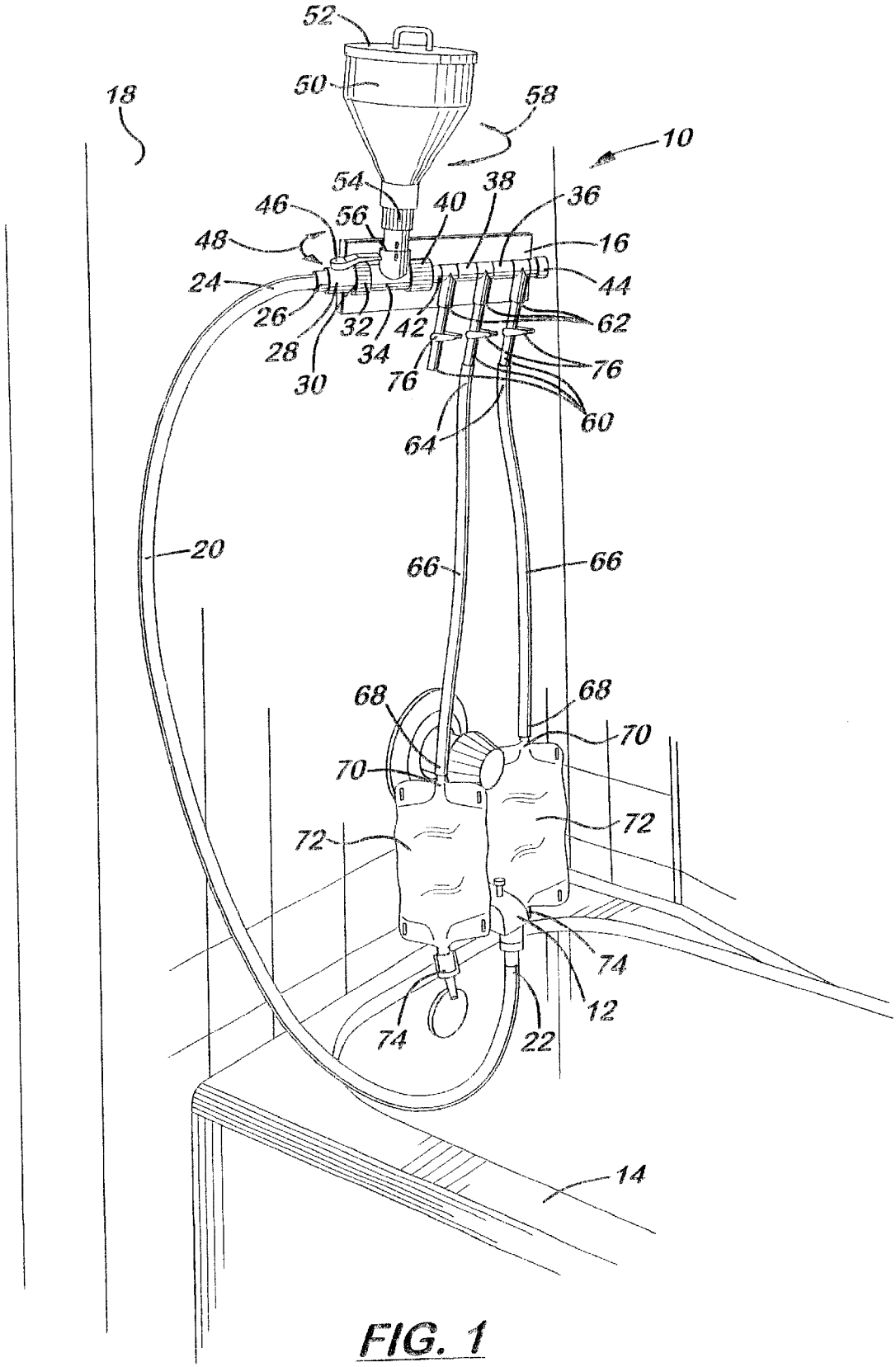
FIG. 1 is a perspective view of the subject urine bag cleaning manifold with an inlet tube attached to a bathtub faucet. Also shown in this drawing are two urine bags attached to and suspended from a pair of outlet tubes attached to outlet valves.

In FIG. 1, a perspective view of the subject urine bag cleaning manifold is illustrated having a general reference numeral 10. The cleaning manifold 10 is adapted for attaching to a bathtub faucet 12 mounted at one end of a bathtub 14. As mentioned above, the cleaning manifold 10 can be used for connection to a bathroom sink faucet and other water outlets without departing from the spirit and scope of the invention. The water temperature from the faucet 12 can be selected at the discretion of the user of the manifold 10. Note, in this example of the use of the cleaning manifold 10, the manifold includes a mounting plate 16 for securing the cleaning manifold 10 to a bathroom wall 18 above the bathtub faucet 12.

The cleaning manifold 10 includes a flexible inlet tube 20 having a first end 22 and a second end 24. The first end 22 of the inlet tube 20 is adapted for connection to the faucet 12. The second end 24 of the inlet tube 20 is attached to an inlet 26 of a water inlet valve 28. An outlet 30 of the water inlet valve 28 is attached to a first end 32 of an upstream mixing section 34. The upstream mixing section 34 is part of a hollow manifold body 36. The hollow manifold body 36 also includes a downstream discharge section 38. A second end 40 of the mixing section 34 is attached to a first end 42 of the discharge section 38. The discharge section 38 also includes a second end 44.

The upstream mixing section 34 of the hollow manifold body 36 is used for receiving and mixing the warm water and the cleaning solution. Note in this drawing, the inlet valve 28 includes a valve handle 46 which is shown in an open position for receiving the warm water from the faucet 12 therein. Arrow 48 indicates the movement of the handle 46 from an open to a closed position.

The downstream discharge section 38 of the manifold body 36 is used for receiving the mixture of the warm water and cleaning solution from the upstream mixing section 34 and discharging the mixture into one or more urine bags and cleaning the bags.

A cleaning solution container 50 with a removable lid 52 over an opening in the top of the container is shown in this drawing. The container 50 is disposed on top of and in communication with a cleaning solution valve 54. The cleaning solution valve 54 is attached to sides of an opening 56 in an upper portion of the mixing section 34. By opening and closing the cleaning solution valve 54, the flow rate of cleaning solution can be controlled as it is feed by gravity into the mixing section 54. Arrow 58 indicates the movement for the opening and the closing of the valve 54. By adjusting the flow rate of cleaning solution and adjusting the flow rate of the warm water, a proper amount of the mixture of the cleaning solution and the water can be used for properly cleaning one or more urine bags. When lifting the removable lid 52, the container 50 can be filled with various types of cleaning solutions, disinfectants, bleach, liquid soaps and the like.

A plurality of outlet valves 60 are attached to sides of openings 62 in a lower portion of the discharge section 38. A first end 64 of a plurality of outlet tubes 66 is attached to the outlet valves 60. A second end 68 of the outlet tubes 66 is adapted for attachment to an inlet 70 of a pair of urine bags 72. The bags 72 include an outlet 74 for draining the cleaning mixture and rinse water therefrom, as indicated by arrow 75 as shown in FIGS., and into the bottom of the bathtub 14. The outlet valves 60 are shown with a valve handle 76 which is used for opening and closing the valves. In this view, the handles 76 are shown in a raised open position.

Figure 2:
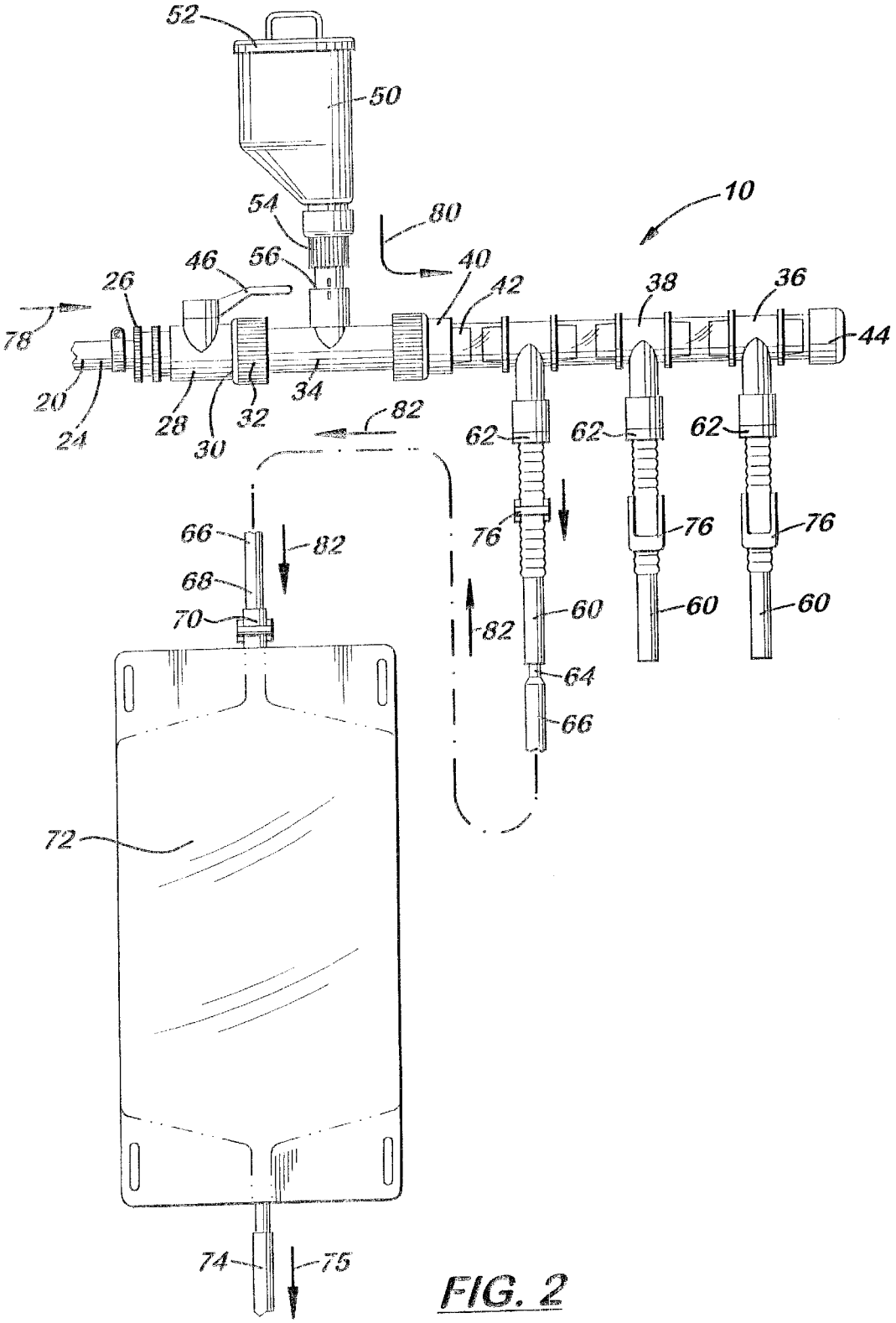
FIG. 2 is a front view of the subject urine bag cleaning manifold showing the manifold construction and the flow of the warm water into the cleaning manifold and the warm water and cleaning solution mixture through the manifold and into a urine bag attached to an outlet tube.

In FIG. 2, a front view of the subject urine bag cleaning manifold 10 is illustrated. In this drawing, the flow, as indicated by arrow 78, of the warm water into the water inlet valve 28. Also the cleaning solution flow, as indicated by arrow 80, is shown into the manifold body 36. Further the warm water and cleaning solution mixture flow, as indicated by arrows 82, are shown flowing into the outlet tube 66 and then into the bag 72.

The handle 46 of the water inlet valve 28 is shown in an open position for receiving warm water through the valve 28 and into the manifold body 36. Also in this drawing, a single urine bag 72 is shown with its inlet 70 attached to the second end 68 of the outlet tube 66. The outlet valve 60 is shown with its handle 76 in a raised open position for receiving the mixture of the warm water and cleaning solution therethrough and into the urine bag 72. The other two outlet valves 60 are shown with their handles in a closed position.

In operation, and using the single urine bag 72 connected to the cleaning manifold 10 shown in FIG. 2 as an example, the following steps of using the urine bag cleaning manifold are as follows. The inlet valve 28, the cleaning solution valve 54 and the outlet valves 60 are closed. The cleaning solution container 50 is filled with a selected detergent. The inlet tube 20 is attached to the faucet 12 and the urine bag 72 to be cleaned is attached to the outlet tube 66. Warm water is now turned "on" and the inlet valve 28 is opened. The cleaning solution valve 54 is opened and adjusted for the proper amount of cleaning solution to be introduced into the warm water. The warm water flow can be adjusted at the faucet 12 or by adjusting the opening in the inlet valve 28. As the warm water flows through the mixing section 34, the water is mixed with the cleaning solution. The mixture is now discharged out the discharge section 38 and the outlet valve 60 when it is opened. The mixture now proceeds through the outlet tube 66 and into the urine bag 72. The inside of the urine bag 72 is cleaned by the mixture as it flows through the bag and out the outlet 74. After the bag 72 has been sufficiently cleaned using the mixture, the cleaning solution valve 54 is now closed. Warm water is now circulated through the cleaning manifold 10 and into the bag 72 for rinsing the inside of the bag. When the rinsing cycle has been completed, the warm water is turned "off" at the faucet 12 and the cleaned urine bag 72 is allowed to drain and dry.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A urine bag cleaning manifold capable of pre-mixing a cleaning solution and water for washing one or more urine bags, the urine bag cleaning manifold is adapted for attaching to a bathroom sink faucet, bathtub faucet and other faucets for circulating the warm water from the faucet and cleaning solution therethrough, the cleaning manifold adapted for introducing the warm water and cleaning solution in an inlet in the top of the urine bag and draining out an outlet in the bottom of the urine bag, the cleaning manifold comprising:

a hollow manifold body having an upstream mixing section having a first end and a second end, the first end of said mixing section adapted for receiving the warm water therein, said manifold body also having a downstream discharge section having a first end and a second end, the second end of said mixing section attached to the first end of said discharge section;

a cleaning solution container attached to sides of an opening in an upper portion of said mixing section, said cleaning solution container adapted for feeding the cleaning solution into said mixing section;

at least one outlet valve attached to sides of an opening in a lower portion of said discharge section; and an outlet tube having a first end and a second end, the first end of said outlet tube attached to said outlet valve, the second end of said outlet tube adapted for attachment to the inlet in the top of the urine bag, said outlet tube extending downwardly from said outlet valve for filling the urine bag by water pressure and gravity and cleaning the urine bag as the warm water and cleaning solution flows downwardly therethrough and out the outlet in the bottom of the urine bag.

2. The cleaning manifold as described in claim 1 further including a water inlet valve having an inlet and an outlet, the outlet of said water inlet valve attached to the first end of said mixing section.

3. The cleaning manifold as described in claim 2 further including a flexible inlet tube having a first end and a second end, the first end of said inlet tube adapted for connection to the faucet, the second end of said inlet tube attached to the inlet of said water inlet valve.

4. The cleaning manifold as described in claim 1 wherein said cleaning solution container is mounted on top of a cleaning solution valve, said cleaning solution valve attached to the sides of the opening in the upper portion of said mixing section.

5. The cleaning manifold as described in claim 1 further including a plurality of outlet valves attached to sides of the openings in the lower portion of said discharge section.

6. The cleaning manifold as described in claim 5 further including a plurality of outlet tubes having a first end and a second end, the first end of said outlet tubes attached to said outlet valves, the second end of said outlet tubes adapted for attachment to inlets in the top of urine bags, said outlet tubes extending downwardly from said outlet valves for filling the urine bags by water pressure and gravity and cleaning the urine bags as the warm water and cleaning solution flows downwardly therethrough and out the outlet in the bottom of the urine bags.

7. A urine bag cleaning manifold capable of pre-mixing a cleaning solution and water for washing one or more urine bags, the urine bag cleaning manifold is adapted for attaching to a bathroom sink faucet, bathtub faucet and other faucets for circulating the warm water from the faucet and cleaning solution therethrough, the cleaning manifold adapted for introducing the warm water and cleaning solution in an inlet in the top of the urine bag and draining out an outlet in the bottom of the urine bag, the cleaning manifold comprising:

a flexible inlet tube having a first end and a second end, the first end of said inlet tube adapted for connection to the faucet;

a water inlet valve having an inlet and an outlet, the second end of said inlet tube attached to the inlet of said inlet valve;

an upstream mixing section having a first end and a second end, the first end of said mixing section attached to the outlet of said inlet valve, said upstream mixing section part of a hollow manifold body;

a downstream discharge section having a first end and a second end, said downstream discharge section part of said hollow manifold body, the second end of said mixing section attached to the first end of said discharge section;

a cleaning solution container attached to sides of an opening in an upper portion of said mixing section, said cleaning solution container adapted for feeding the cleaning solution into said mixing section;

at least one outlet valve attached to sides of an opening in a lower portion of said discharge section; and an outlet tube having a first end and a second end, the first end of said outlet tube attached to said outlet valve, the second end of said outlet tube adapted for attachment to the inlet in the top of the urine bag, said outlet tube extending downwardly from said outlet valve for filling the urine bag by water pressure and gravity and cleaning the urine bag as the warm water and cleaning solution flows downwardly therethrough and out the outlet in the bottom of the urine bag.

8. The cleaning manifold as described in claim 7 wherein said cleaning solution container is mounted on top of a cleaning solution valve, said cleaning solution valve attached to the sides of the opening in the upper portion of said mixing section.

9. The cleaning manifold as described in claim 7 further including a plurality of outlet valves attached to sides of the openings in the lower portion of said discharge section.

10. The cleaning manifold as described in claim 9 further including a plurality of outlet tubes having a first end and a second end, the first end of said outlet tubes attached to said outlet valves, the second end of said outlet tubes adapted for attachment to inlets in the top of urine bags, said outlet tubes extending downwardly from said outlet valves for filling the urine bags by water pressure and gravity and cleaning the urine bags as the warm water and cleaning solution flows downwardly therethrough and out the outlet in the bottom of the urine bags.

11. A urine bag cleaning manifold capable of pre-mixing a cleaning solution and water for washing one or more urine bags, the urine bag cleaning manifold is adapted for attaching to a bathroom sink faucet, bathtub faucet and other faucets for circulating the warm water from the faucet and cleaning solution therethrough, the cleaning manifold adapted for introducing the warm water and cleaning solution in an inlet in the top of the urine bag and draining out an outlet in the bottom of the urine bag, the cleaning manifold comprising:

a flexible inlet tube having a first end and a second end, the first end of said inlet tube adapted for connection to the faucet;

a water inlet valve having an inlet and an outlet, the second end of said inlet tube attached to the inlet of said inlet valve;

an upstream mixing section having a first end and a second end, the first end of said mixing section attached to the outlet of said inlet valve, said upstream mixing section part of a hollow manifold body;

a downstream discharge section having a first end and a second end, said downstream discharge section part of said hollow manifold body, the second end of said mixing section attached to the first end of said discharge section;

a cleaning solution container attached to sides of an opening in an upper portion of said mixing section, said cleaning solution container adapted for feeding the cleaning solution into said mixing section;

a plurality of outlet valves attached to sides of openings in a lower portion of said discharge section; and a plurality of outlet tubes having a first end and a second end, the first end of said outlet tubes attached to said outlet valves, the second end of said outlet tubes adapted for attachment to the inlet in the top of urine bags, said outlet tubes extending downwardly from said outlet valves for filling the urine bags by water pressure and gravity and cleaning the urine bags as the warm water and cleaning solution flows downwardly therethrough and out the outlet in the bottom of the urine bags.

* * * * *